US008634571B2

(12) United States Patent
Sakamoto et al.

(10) Patent No.: US 8,634,571 B2
(45) Date of Patent: Jan. 21, 2014

(54) ACTIVE TYPE ACOUSTIC CONTROL SYSTEM

(75) Inventors: Kosuke Sakamoto, Utsunomiya (JP); Toshio Inoue, Tochigi-ken (JP); Akira Takahashi, Tochigi-ken (JP); Yasunori Kobayashi, Utsunomiya (JP); Shungo Fueki, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 448 days.

(21) Appl. No.: 13/126,431

(22) PCT Filed: Jun. 4, 2009

(86) PCT No.: PCT/JP2009/060242

§ 371 (c)(1),
(2), (4) Date: Apr. 27, 2011

(87) PCT Pub. No.: WO2010/050264

PCT Pub. Date: May 6, 2010

(65) Prior Publication Data

US 2011/0206213 A1 Aug. 25, 2011

(30) Foreign Application Priority Data

Oct. 28, 2008 (JP) ..... 2008-276368

(51) Int. Cl.
*G10K 11/16* (2006.01)

(52) U.S. Cl.
USPC ..... 381/71.4; 381/86

(58) Field of Classification Search
USPC ..... 381/71.4
See application file for complete search history.

(56) References Cited

U.S. PATENT DOCUMENTS

| | | | |
|---|---|---|---|
| 5,692,052 | A | 11/1997 | Tanaka et al. |
| 2004/0258251 | A1 | 12/2004 | Inoue et al. |
| 2006/0215846 | A1 | 9/2006 | Kobayashi et al. |
| 2006/0269078 | A1 | 11/2006 | Sakamoto et al. |
| 2008/0240456 | A1 | 10/2008 | Sakamoto et al. |
| 2009/0074198 | A1 | 3/2009 | Yoshida et al. |

FOREIGN PATENT DOCUMENTS

| | | | |
|---|---|---|---|
| CN | 1573916 | A | 6/2004 |
| CN | 101031957 | A | 9/2007 |
| JP | 04-194996 | A | 7/1992 |
| JP | 2005-10253 | A | 1/2005 |
| JP | 2005-299505 | A | 10/2005 |
| JP | 2006-327540 | A | 12/2006 |
| JP | 2008-247221 | A | 10/2008 |
| WO | WO 90/13109 | A1 | 11/1990 |

OTHER PUBLICATIONS

Chinese Office Action, 200980143234.9 dated Nov. 30, 2012.

*Primary Examiner* — Joseph Saunders, Jr.
(74) *Attorney, Agent, or Firm* — Arent Fox LLP

(57) ABSTRACT

In an acoustic control system an operation range of an active type noise control device (an ANC device) and an operation range of an active type effect sound control device (an ASC device) are exchanged in accordance with the number of working cylinders of an engine.

1 Claim, 7 Drawing Sheets

ALL-CYLINDER MODE

TWO-CYLINDERS-DEACTIVATION MODE

THREE-CYLINDERS-DEACTIVATION MODE

ALL-CYLINDER MODE

TWO-CYLINDERS-DEACTIVATION MODE

THREE-CYLINDERS-DEACTIVATION MODE

ACTIVE TYPE ACOUSTIC CONTROL SYSTEM

CROSS-REFERENCE TO RELATED APPLICATION

This application is a National Stage entry of International Application No. PCT/JP2009/060242, having an international filing date of Jun. 4, 2009, which claims priority to Japanese Application No.: 2008-276368, filed Oct. 28, 2008, the disclosure of each of which is hereby incorporated in its entirety by reference.

TECHNICAL FIELD

The present invention relates to an active acoustic control system (active type acoustic control system) including an active noise control apparatus and an active sound control apparatus.

BACKGROUND ART

There are known an active noise control apparatus (hereinafter referred to as an "ANC apparatus") and an active sound control apparatus (hereinafter referred to as an "ASC apparatus") as apparatuses for controlling acoustics in relation to noise within the passenger compartment of a vehicle.

The ANC apparatus generates a canceling sound for canceling a noise such as a noise (muffled engine sound) that is generated in the passenger compartment of the vehicle by the operation (vibration) of the engine and a noise (road noise) that is generated in the passenger compartment by the contact between the wheels and the road while the vehicle is traveling, and reduces the noise with the canceling sound. Some ANC apparatuses are selectively turned on and off depending on the number of engine cylinders in operation and change frequencies to be controlled (see, for example, U.S. patent application Publication No. 2004/0258251).

An ASC apparatus generates a sound effect (quasi-engine sound) in synchronism with the muffled engine sound to enhance an acoustic effect in the passenger compartment, e.g., to emphasize a change in the speed of the vehicle (see, for example, U.S. patent application Publication No. 2006/0215846).

There has also been developed an active acoustic control system which employs an ANC apparatus and an ASC apparatus in combination (see, for example, International Publication No. WO 90/13109 and U.S. patent application Publication No. 2006/0269078). According to International Publication No. WO 90/13109, the ANC apparatus and the ASC apparatus are always in operation. According to U.S. patent application Publication No. 2006/0269078, in order to prevent the ANC apparatus and the ASC apparatus from interfering with each other, the ANC apparatus and the ASC apparatus are activated and inactivated in relation to each other depending on a combination of an engine rotational frequency [Hz] and a change per unit time in the engine rotational frequency (engine rotational frequency change) [Hz/s] (see FIG. 5 of U.S. patent application Publication No. 2006/0269078).

SUMMARY OF INVENTION

The invention disclosed in U.S. patent application Publication No. 2006/0269078 still remains to be improved for using the ANC apparatus and the ASC apparatus in more appropriate situations.

The present invention has been made in view of the above problems. It is an object of the present invention to provide an active acoustic control system which is capable of controlling an ANC apparatus and an ASC apparatus more appropriately.

According to the present invention, an active acoustic control system comprises an active noise control apparatus (ANC apparatus) for outputting a canceling sound (CS) to cancel a passenger compartment noise, an active sound control apparatus (ASC apparatus) for outputting a quasi-engine sound, and an operation switcher for switching between operation of the ANC apparatus and operation of the ASC apparatus, based on an operational range of the ANC apparatus and an operational range of the ASC apparatus which are related to at least one of a vehicle speed, an engine rotation frequency, a vehicle speed change, and an engine rotation frequency change, wherein the operation switcher changes the operational range of the ANC apparatus and the operational range of the ASC apparatus depending on an active cylinder number of an engine.

According to the present invention, the operation switcher changes the operational range of the ANC apparatus and the operational of the ASC apparatus, which are related to at least one of a vehicle speed, an engine rotation frequency, a vehicle speed change, and an engine rotation frequency change, depending on the active cylinder number of the engine. It is thus possible to perform an acoustic control process depending on the active cylinder number. As a result, the ANC apparatus and the ASC apparatus can be used in a more appropriate situation.

If the operational range of the ANC apparatus and the operational range of the ASC apparatus are defined by at least the engine rotation frequency, then the engine rotation frequency may have a minimum value for operating the ANC apparatus, the minimum value being set to a quotient obtained by dividing a minimum value of frequencies to be controlled by the ANC apparatus, by the order, with respect to the engine rotation frequency, of a chiefly generated frequency component of the passenger compartment noise depending on the active cylinder number, and the engine rotation frequency may have a maximum value for operating the ANC apparatus, the maximum value being set to a quotient obtained by dividing a maximum value of the frequencies to be controlled by the ANC apparatus, by the order. In this manner, an operational range for the ANC apparatus can be set appropriately.

If the operational range of the ANC apparatus and the operational range of the ASC apparatus are defined by at least the vehicle speed change or the engine rotation frequency change, then as the active cylinder number is greater, a minimum value of the vehicle speed change or the engine rotation frequency change for operating the ASC apparatus may be set to a lower value. Generally, as a torque which the engine is required to produce is higher, the active cylinder number is greater, and when the torque is high, the driver of the vehicle often wants to drive the vehicle in a sporty way. According to the present invention, as the active cylinder number is greater, the minimum value of the vehicle speed change or the minimum value of the engine rotational speed change for operating the ASC apparatus is set to a lower value to make the ASC apparatus operable more easily. Thus, the ASC apparatus is operated in a manner to meet the demands of the driver.

DESCRIPTION OF EMBODIMENTS

A. Embodiment

Figure 1:
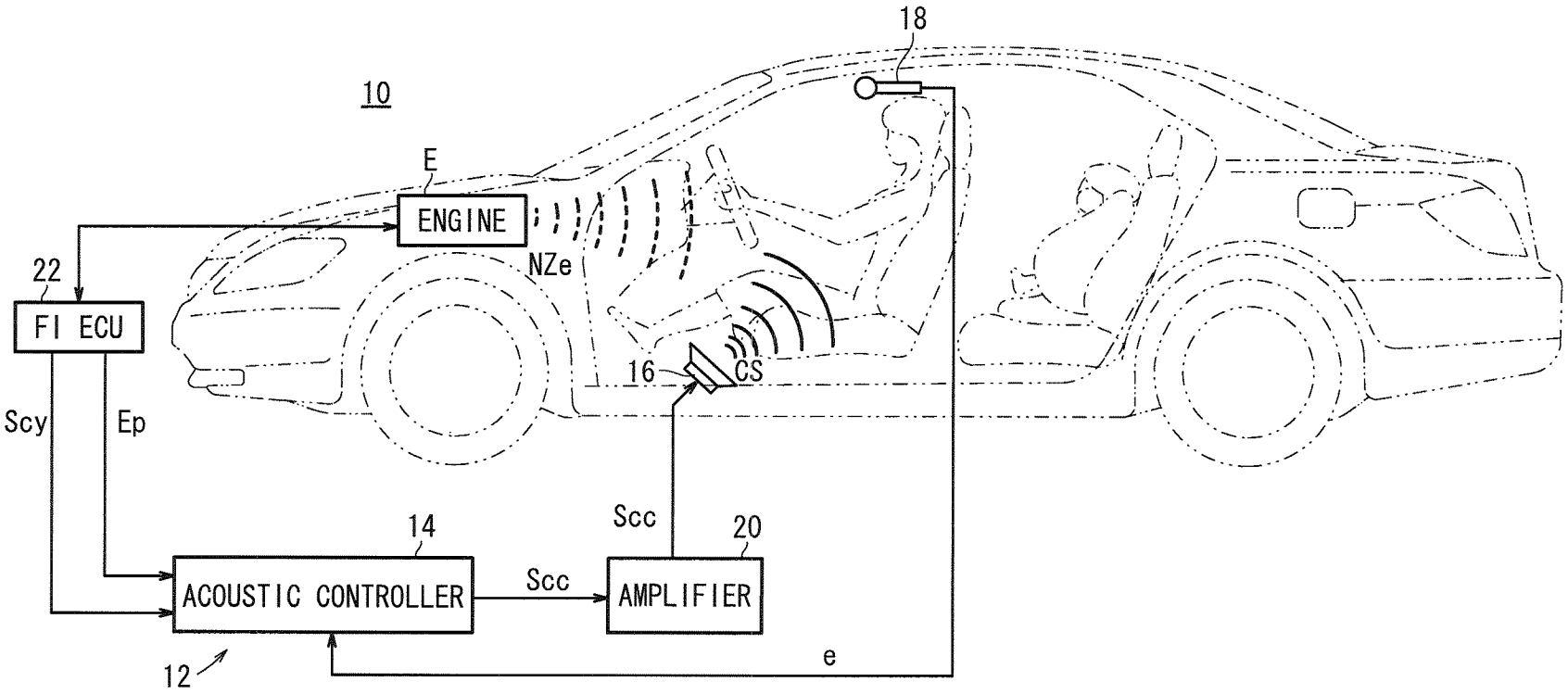
FIG. 1 is a schematic view of a vehicle which incorporates an active acoustic control system according to an embodiment of the present invention.

1. Overall and Componential Arrangement (1) Overall Arrangement:

FIG. 1 is a schematic view of a vehicle 10 which incorporates an active acoustic control system 12 (hereinafter referred to as an "acoustic control system 12") according to an embodiment of the present invention. The vehicle 10 may be a gasoline-powered vehicle, an electric vehicle, a fuel cell vehicle, or the like. The acoustic control system 12 has the functions of both an ANC apparatus and an ASC apparatus.

The acoustic control system 12 includes an acoustic controller 14, a speaker 16, a microphone 18, and an amplifier 20. In the acoustic control system 12, a fuel injection controller 22 {hereinafter referred to as "FI ECU 22" (Fuel Injection Electronic Control Unit 22)} for controlling fuel injection of an engine E inputs engine pulses Ep from the engine E and an active cylinder number signal Scy to the acoustic controller 14. When the acoustic controller 14 is operating as the ANC apparatus, an error signal e is input through the microphone 18 to the acoustic controller 14. Based on the engine pulses Ep, the active cylinder number signal Scy, and the error signal e, the acoustic controller 14 generates and outputs a combined control signal Scc representative of the waveform of a control sound CS through the amplifier 20 to the speaker 16. The speaker 16 outputs the control sound CS represented by the combined control signal Scc. When the acoustic controller 14 is operating as the ANC apparatus, the control sound CS is a canceling sound for a muffled engine sound NZe. When the acoustic controller 14 is operating as the ASC apparatus, the control sound CS is a quasi-engine sound. When the acoustic controller 14 is operating as the ANC apparatus, the microphone 18 detects a residual noise left after the canceling sound has canceled the muffled engine sound NZe, and outputs an electric signal (error signal e) representative of the detected residual noise to the acoustic controller 14. The acoustic controller 14 uses the error signal e in generating the control sound CS serving as the canceling sound.

(2) Engine E and FI ECU 22:

In the present embodiment, the engine E is an engine having six cylinders each operating in four strokes (intake→compression→explosion→exhaust). The six cylinders are combined with one crankshaft. The six cylinders are arranged such that when all of them are in operation, explosion strokes take place in the cylinders at equal rotational angles.

In order for each cylinder to operate in the four strokes, the crankshaft needs to make two revolutions, with the intake and compression strokes in the first revolution and the explosion and exhaust strokes in the second revolution. Therefore, it is necessary that each explosion stroke takes place at every angle of 120° of the crankshaft rotation which is calculated by dividing the angle through which the crankshaft makes two revolutions (720°=360°×two revolutions) by six (the number of cylinders). The three sets of two cylinders are arranged with respect to the crankshaft at angular intervals of 120°, and while one of the two cylinders which are disposed at the same angular position is in the explosion stroke, the other cylinder is in the intake stroke.

Figure 2:
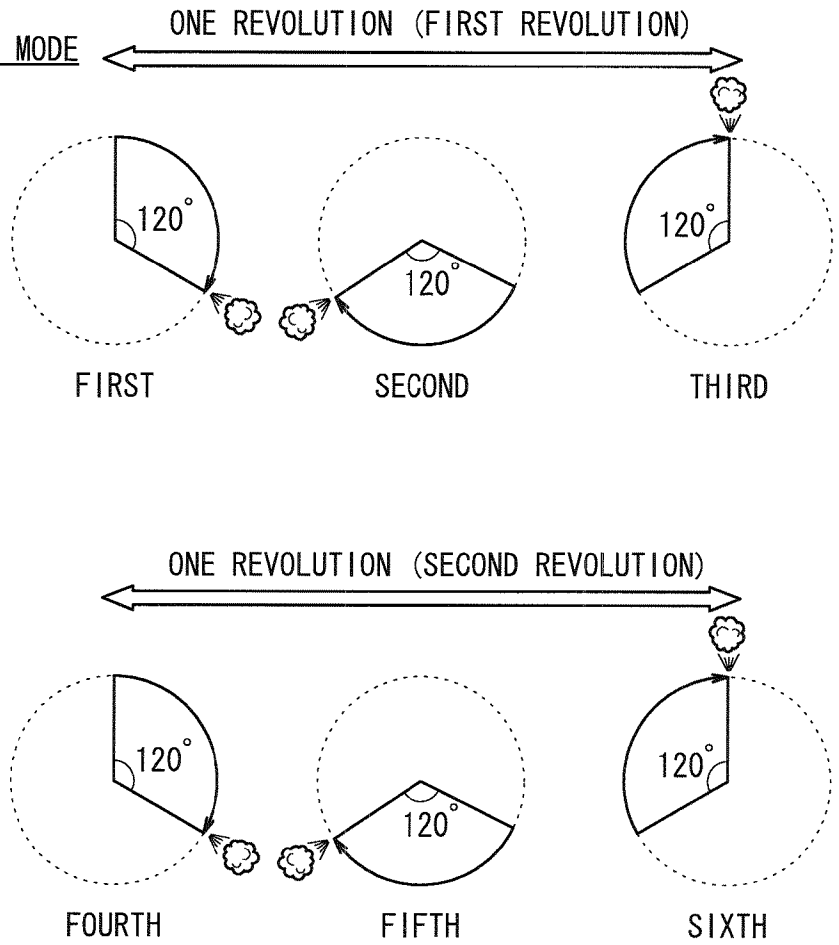
FIG. 2 is a diagram showing a relationship between a rotational angle of the crankshaft of an engine and an explosion stroke of a cylinder of the engine when the engine is in an all-cylinder mode.

FIG. 2 is a diagram showing the relationship between the rotational angle of the crankshaft of the engine and the explosion strokes of the cylinders when the engine is in an all-cylinder mode in which all the cylinders are active. In the all-cylinder mode, when the crankshaft rotates through 120°, the first explosion occurs in the first cylinder. When the crankshaft further rotates through 120° (when the crankshaft rotates through a total of)240°, the second explosion occurs in the second cylinder. When the crankshaft further rotates through 120° (when the crankshaft rotates through a total of 360°), the third explosion occurs in the third cylinder. When the crankshaft further rotates through 120° (when the crankshaft rotates through a total of 480°), the fourth explosion occurs in the fourth cylinder. When the crankshaft further rotates through 120° (when the crankshaft rotates through a total of 600°), the fifth explosion occurs in the fifth cylinder. When the crankshaft further rotates through 120° (when the crankshaft rotates through a total of 720°), the sixth explosion occurs in the sixth cylinder.

The engine E according to the present embodiment also operates in cylinders-deactivation modes in which some cylinders are deactivated, for the purpose of achieving better mileage when the engine E produces a low torque and rotates at a high engine rotational speed (such as when the vehicle is cruising). The cylinders-deactivation modes include a two-cylinders-deactivation mode in which four of the six cylinders are activated and the remaining two cylinders are deactivated and a three-cylinders-deactivation mode in which three of the six cylinders are activated and the remaining three cylinders are deactivated.

Figure 3:
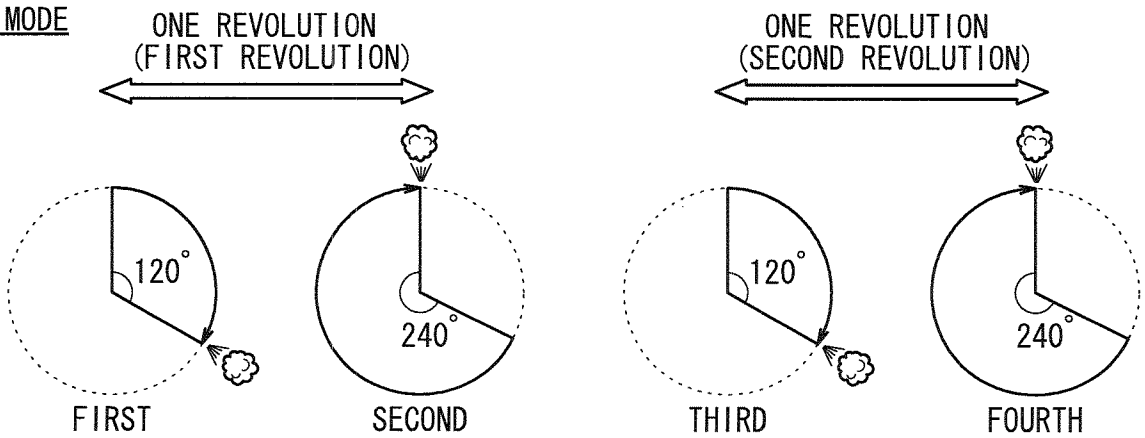
FIG. 3 is a diagram showing a relationship between a rotational angle of the crankshaft and an explosion stroke of a cylinder of the engine when the engine is in a two-cylinders-deactivation mode.

As the crankshaft and the cylinders are physically connected to each other, the correlation between the rotational angle of the crankshaft and the angular positions of the explosion strokes cannot be changed. In the two-cylinders-deactivation mode, the explosion strokes take place as shown in FIG. 3, for example. In the three-cylinders-deactivation mode, the explosion strokes take place as shown in FIG. 4, for example.

In the two-cylinders-deactivation mode, as shown in FIG. 3, when the crankshaft rotates through 120°, the first explosion occurs in the first cylinder. When the crankshaft further rotates through 240° (when the crankshaft rotates through a total of 360°), the second explosion occurs in the third cylinder (no explosion occurs in the second cylinder). When the crankshaft further rotates through 120° (when the crankshaft rotates through a total of 480°), the third explosion occurs in the fourth cylinder. When the crankshaft further rotates through 240° (when the crankshaft rotates through a total of 720°), enters the fourth explosion occurs in the sixth cylinder (no explosion occurs in the fifth cylinder).

Figure 4:
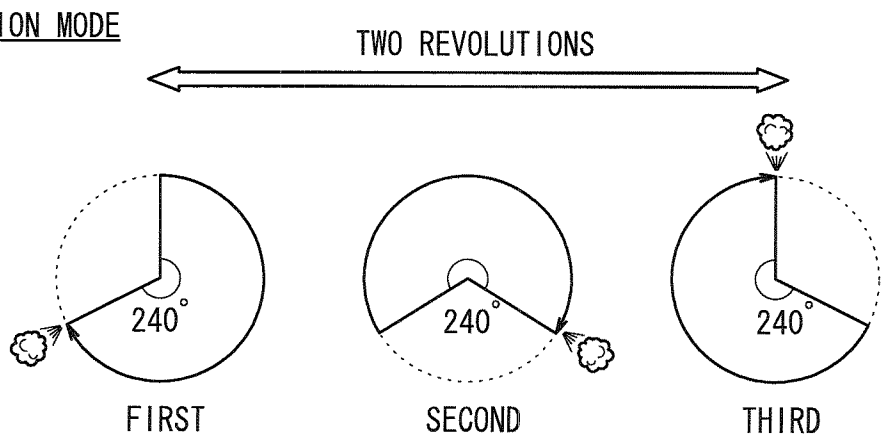
FIG. 4 is a diagram showing a relationship between a rotational angle of the crankshaft and an explosion stroke of a cylinder of the engine when the engine is in a three-cylinders-deactivation mode.

In the three-cylinders-deactivation mode, as shown in FIG. 4, when the crankshaft rotates through 240°, the second cylinder enters the first explosion stroke (the first cylinder does not enter the explosion stroke). When the crankshaft further rotates through 240° (when the crankshaft rotates through a total of 480°), the fourth cylinder enters the second explosion stroke (the third cylinder does not enter the explosion stroke). When the crankshaft further rotates through 240° (when the crankshaft rotates through a total of 720°), the sixth cylinder enters the third explosion stroke (the fifth cylinder does not enter the explosion stroke).

Whether the engine E is to operate in the all-cylinder mode, the two-cylinders-deactivation mode, or the three-cylinders-deactivation mode is determined by the FI ECU 22 which controls the ignition timings, etc. of the engine E depending on parameters including a torque which the engine E is required to produce.

The FI ECU 22 controls the fuel injection and ignition of the engine E, and sends engine pulses Ep and an active cylinder number signal Scy to the acoustic control system 12.

An engine pulse Ep output by the FI ECU 22 is a signal which goes high when the piston (not shown) in each cylinder reaches the top dead center. Since the engine E according to the present embodiment has six cylinders, the engine pulse signal goes high six times every two revolutions of the crankshaft, i.e., the engine pulse signal goes high three times every one revolution of the crankshaft, irrespective of which mode the engine E operates in.

The active cylinder number signal Scy is representative of the number of active cylinders (active cylinder number Ncy). According to the present embodiment, the active cylinder number signal Scy represents six in the all-cylinder mode, four in the two-cylinders-deactivation mode, and three in the three-cylinders-deactivation mode.

Figure 5:
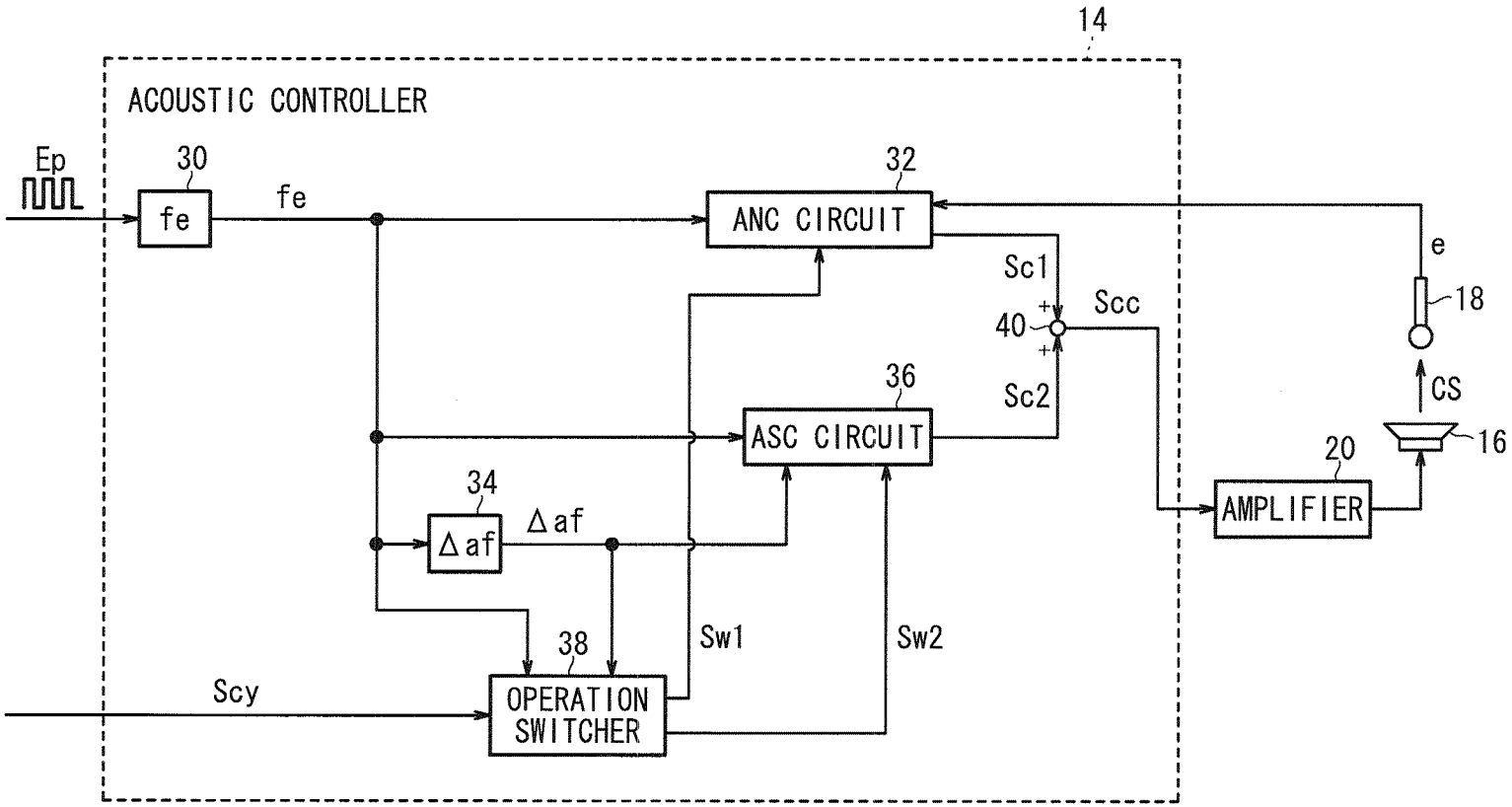
FIG. 5 is a block diagram of an acoustic controller of the active acoustic control system according to the embodiment of the present invention.

(3) Acoustic Controller 14:

(a) Overall Arrangement:

FIG. 5 shows an internal arrangement of the acoustic controller 14. The acoustic controller 14 includes an engine rotation frequency detector 30 (hereinafter referred to as a "detector 30"), an ANC circuit 32, an engine rotation frequency change detector 34 (hereinafter referred to as a "detector 34"), an ASC circuit 36, an operation switcher 38, and an adder 40.

(b) Engine Rotation Frequency Detector 30:

The detector 30 detects an engine rotation frequency fe [Hz] based on the engine pulses Ep from the FI ECU 22, and outputs the detected engine rotation frequency fe to the ANC circuit 32, the detector 34, the ASC circuit 36, and the operation switcher 38. As described above, the engine pulse Ep goes high three times during one revolution of the crankshaft, irrespective of which mode the engine E operates in. One period of the engine pulse Ep is equal to the time period in which the engine E makes a ⅓ revolution. Based on this relationship, the engine rotation frequency fe can be calculated by detecting the time from the rising edge of an engine pulse Ep to the rising edge of the next engine pulse Ep, for example.

(c) ANC Circuit 32:

The ANC circuit 32 generates a control signal Sc1 based on the engine rotation frequency fe from the detector 30 and the error signal e from the microphone 18, and outputs the generated control signal Sc1 to the adder 40. The control signal Sc1 represents the waveform of the control sound CS serving as a canceling sound for canceling the muffled engine sound NZe. The ANC circuit 32 generates a reference signal (canceling sound reference signal) for the control sound CS based on the engine rotation frequency fe, and performs an adaptive filtering process on the canceling sound reference signal thereby to generate the control signal Sc1. In the adaptive filtering process, the canceling sound reference signal is passed through an adaptive filter. The adaptive filter has filter coefficients which are set to minimize the error signal e based on a reference signal, which is generated by correcting the canceling sound reference signal based on transfer characteristics from the speaker 16 to the microphone 18, and the error signal e. The ANC circuit 32 may be one of the circuits disclosed in U.S. patent application Publication No. 2004/0258251 and U.S. patent application Publication No. 2006/0269078, for example.

As described later, when the ANC circuit 32 receives an output stop signal Sw1 from the operation switcher 38, the ANC circuit 32 reduces the amplitude of the control signal Sc1 to zero, essentially eliminating its output signal.

(d) Engine Rotation Frequency Change Detector 34:

The detector 34 calculates an engine rotation frequency change Δaf (a change in the engine rotation frequency fe per unit time) [Hz/s] based on the engine rotation frequency fe from the detector 30, and outputs the engine rotation frequency change Δaf to the ASC circuit 36 and the operation switcher 38.

(e) ASC Circuit 36:

The ASC circuit 36 generates a control signal Sc2 based on the engine rotation frequency fe from the detector 30 and the engine rotation frequency change Δaf from the detector 34, and outputs the control signal Sc2 to the adder 40. The control signal Sc2 represents the waveform of the control signal CS serving as a sound effect (quasi-engine sound) in synchronism with the muffled engine sound NZe. The ASC circuit 36 generates a reference signal (sound effect reference signal) for the control sound CS based on the engine rotation frequency fe, and performs various sound pressure adjusting processes on the sound effect reference signal thereby to generate the control signal Sc2. The sound pressure adjusting processes include a process for increasing a gain used for the sound effect reference signal in response to increase in the engine rotation frequency change Δaf (Δaf-specific sound pressure adjusting process). The ASC circuit 36 may generate a plurality of sound effect reference signals depending on the order (1st order, 1.5th order, 3rd order, etc.) of the engine rotation frequency fe. If the ASC circuit 36 generates a plurality of sound effect reference signals, then the ASC circuit 36 may perform different amplitude adjusting processes on the sound effect reference signals depending on the engine rotation frequency and the order thereof, combine the amplitude-adjusted sound effect reference signals into a combined sound effect reference signal, and then perform the Δaf-specific sound pressure adjusting process on the combined sound effect reference signal. The ASC circuit 36 may be one of the circuits disclosed in U.S. patent application Publication No. 2006/0215846 and U.S. patent application Publication No. 2006/0269078, for example.

As described later, when the ASC circuit 36 receives an output stop signal Sw2 from the operation switcher 38, the ASC circuit 36 reduces the amplitude of the control signal Sc2 to zero, essentially eliminating its output signal.

(f) Adder 40:

The adder 40 combines the control signal Sc1 from the ANC circuit 32 and the control signal Sc2 from the ASC circuit 36 into a combined control signal Scc, and outputs the combined control signal Scc through the amplifier 20 to the speaker 16.

(g) Operation Switcher 38:

The operation switcher 38 generates an output stop signal Sw1, an output stop signal Sw2 or both of them based on the active cylinder number signal Scy from the FI ECU 22, the engine rotation frequency fe from the detector 30, and the engine rotation frequency change Δaf from the detector 34. The operation switcher 38 sends the output stop signal Sw1 to the ANC circuit 32 and sends the output stop signal Sw2 to the ASC circuit 36 for thereby controlling operation of the ANC circuit 32 and operation of the ASC circuit 36.

Specifically, the operation switcher 38 selects an operational range defining table depending on the active cylinder number signal Scy from a plurality of operational range defining tables. The operational range defining tables serve to define an operational range of the ANC circuit 32 and an operational range of the ASC circuit 36 based on the engine rotation frequency fe and the engine rotation frequency change Δaf. According to the present embodiment, the operational range defining tables include an all-cylinder table corresponding to the all-cylinder mode (see FIG. 6A), a two-cylinders-deactivation table corresponding to the two-cylinders-deactivation mode (see FIG. 6B), and a three-cylinders-deactivation table corresponding to the three-cylinders-deactivation mode (see FIG. 6C). Each of FIGS. 6A through 6C has a horizontal axis representing an engine rotational speed Ne [rpm] which is equal to 60 times the engine rotation frequency fe and a vertical axis representing an engine rotational speed change ΔNe [rpm/s] which is equal to 60 times the engine rotation frequency change Δaf.

Figure 6A:
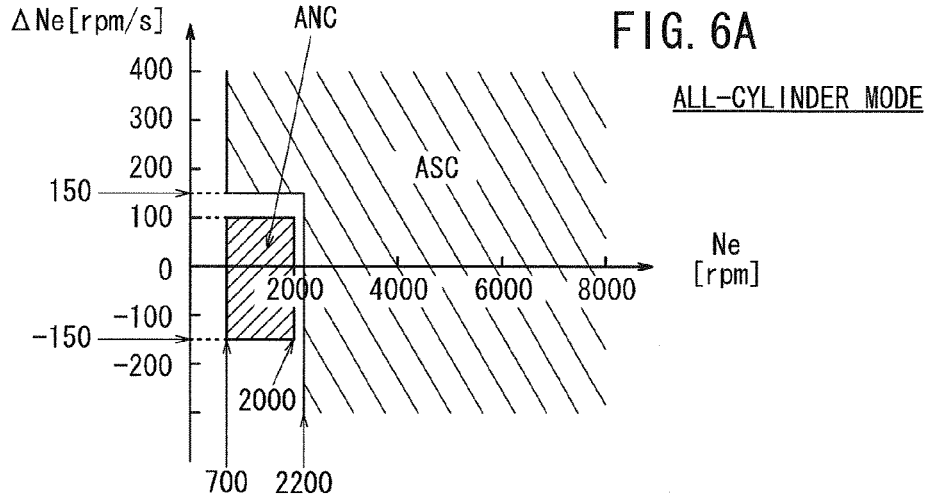
FIG. 6A is a diagram showing an operational range defining table in the all-cylinder mode.

The operation switcher 38 switches between operation of the ANC circuit 32 and operation of the ASC circuit 36 based on the selected operational range defining table, the engine rotation frequency fe, and the engine rotation frequency change Δaf. For example, if the all-cylinder table shown in FIG. 6A is selected, the engine rotational speed Ne is 3000 [rpm], and the engine rotational speed change ΔNe is 50 [rpm/s], then the operation switcher 38 sends the output stop signal Sw1 to the ANC circuit 32 and does not send the output stop signal Sw2 to the ASC circuit 36, thereby operating the ASC circuit 36. If the two-cylinders-deactivation table shown in FIG. 6B is selected, the engine rotational speed Ne is 3000 [rpm], and the engine rotational speed change ΔNe is 50 [rpm/s], then the operation switcher 38 sends the output stop signal Sw2 to the ASC circuit 36 and does not send the output stop signal Sw1 to the ANC circuit 32, thereby operating the ANC circuit 32.

In the all-cylinder table shown in FIG. 6A, the operation switcher 38 operates the ANC circuit 32 if the engine rotational speed Ne is in the range from 700 to 2000 [rpm] and the engine rotational speed change ΔNe is in the range from −150 to 100 [rpm/s]. Also, the operation switcher 38 operates the ASC circuit 36 if the engine rotational speed Ne is equal to or higher than 2200 [rpm] or the engine rotational speed change ΔNe is equal to or higher than 150 [rpm/s]. Further, the operation switcher 38 does not operate either of the ANC circuit 32 and the ASC circuit 36 (i.e., sends the output stop signal Sw1 to the ANC circuit 32 and the output stop signal Sw2 to the ASC circuit 36) if the engine rotational speed Ne and the engine rotational speed change ΔNe are in ranges other than the above.

Figure 6B:
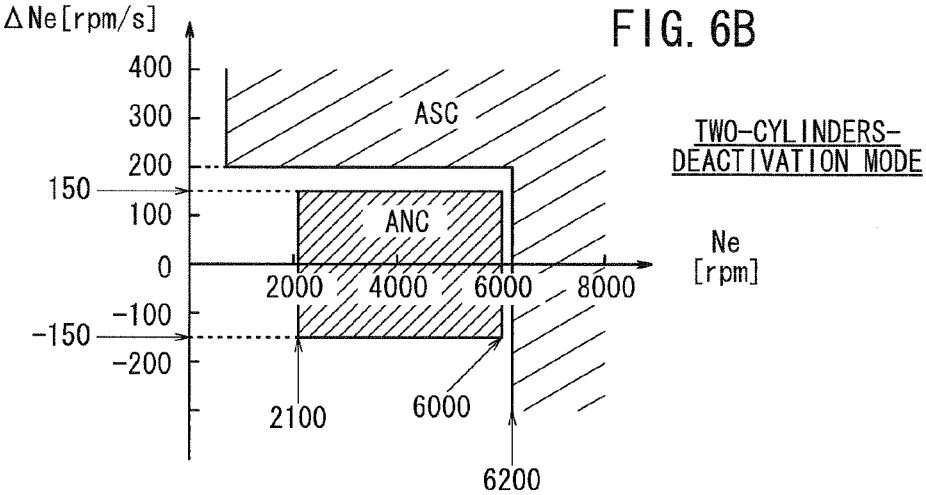
FIG. 6B is a diagram showing an operational range defining table in the two-cylinders-deactivation mode.

In the two-cylinders-deactivation table shown in FIG. 6B, the operation switcher 38 operates the ANC circuit 32 if the engine rotational speed Ne is in the range from 2100 to 6000 [rpm] and the engine rotational speed change ΔNe is in the range from −150 to 150 [rpm/s]. Also, the operation switcher 38 operates the ASC circuit 36 if the engine rotational speed Ne is equal to or higher than 6200 [rpm] or the engine rotational speed change ΔNe is equal to or higher than 200 [rpm/s]. Further, the operation switcher 38 does not operate either of the ANC circuit 32 and the ASC circuit 36 if the engine rotational speed Ne and the engine rotational speed change ΔNe are in ranges other than the above.

Figure 6C:
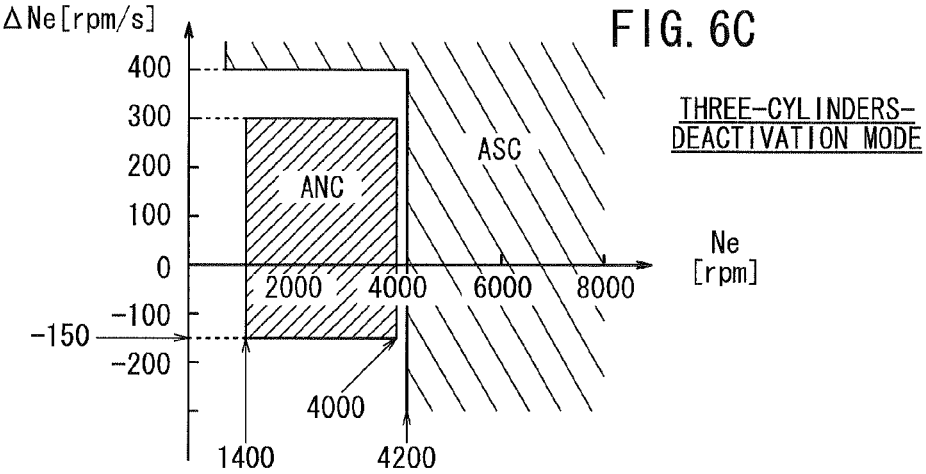
FIG. 6C is a diagram showing an operational range defining table in the three-cylinders-deactivation mode.

In the three-cylinders-deactivation table shown in FIG. 6C, the operation switcher 38 operates the ANC circuit 32 if the engine rotational speed Ne is in the range from 1400 to 4000 [rpm] and the engine rotational speed change ΔNe is in the range from −150 to 300 [rpm/s]. Also, the operation switcher 38 operates the ASC circuit 36 if the engine rotational speed Ne is equal to or higher than 4200 [rpm] or the engine rotational speed change ΔNe is equal to or higher than 400 [rpm/s]. Further, the operation switcher 38 does not operate either of the ANC circuit 32 and the ASC circuit 36 if the engine rotational speed Ne and the engine rotational speed change ΔNe are in ranges other than the above.

In each of the operational range defining tables, the maximum and minimum values of the engine rotational speed Ne for operating the ANC circuit 32 are determined depending on the minimum and maximum values of frequencies to be controlled by an ANC apparatus. The ANC apparatus is made up of the detector 30, the ANC circuit 32, the amplifier 20, the speaker 16, and the microphone 18. The minimum value of the frequencies to be controlled by the ANC apparatus according to the present embodiment is 35 [Hz], and the maximum value thereof is 100 [Hz] (i.e., the ANC apparatus cancels a noise in the frequency range from 35 to 100 Hz).

As shown in FIG. 2, when the engine E is operating in the all-cylinder mode, three explosions occur at equal angular intervals (i.e., every 120°) each time the crankshaft of the engine E makes one revolution. Therefore, the muffled engine sound NZe generated at this time chiefly includes a 3rd-order component of the engine rotation frequency fe. A quotient obtained by dividing the minimum value of the frequencies to be controlled by the AMC apparatus by 3 (i.e., 35÷3) represents the minimum value of the engine rotational speed fe for operating the ANC circuit 32. Then, the quotient is multiplied by 60 thereby to obtain the minimum value of the engine rotational speed Ne of 700 [rpm] (=35÷3×60). Similarly, a quotient obtained by dividing the maximum value of the frequencies to be controlled by the ANC apparatus by 3 (i.e., 100÷3) represents the maximum value of the engine rotational speed fe for operating the ANC circuit 32. The quotient is multiplied by 60 thereby to obtain the maximum value of the engine rotational speed Ne of 2000 [rpm] (=100÷3×60).

As shown in FIG. 3, when the engine E is operating in the two-cylinders-deactivation mode, two explosions occur each time the crankshaft of the engine E makes one revolution. At this time, the explosions do not occur at equal angular intervals. More specifically, the first explosion and the second explosion are angularly spaced by an angular interval of 240°, the second explosion and the third explosion are angularly spaced by an angular interval of 120°, and the first explosion and the third explosion are angularly spaced by an angular interval of 360°. As these angular intervals appear once each time the crankshaft of the engine E makes one revolution, the muffled engine sound NZe chiefly includes a 1st-order component)(360°), a 1.5th-order component)(240°), and a 3rd-order component)(120°) of the engine rotation frequency fe. Of these components, the 1st-order component is the lowest. A quotient obtained by dividing the minimum value of the frequencies to be controlled by the ANC apparatus by 1 (i.e., 35÷1) represents the minimum value of the engine rotational speed fe for operating the ANC circuit 32. Then, the quotient is multiplied by 60 thereby to obtain the minimum value of the engine rotational speed Ne of 2100 [rpm] (=35÷1×60).

Similarly, a quotient obtained by dividing the maximum value of the frequencies to be controlled by the ANC apparatus by 1 (i.e., 100÷1) represents the maximum value of the engine rotational speed fe for operating the ANC circuit 32. Then, the quotient is multiplied by 60 thereby to obtain the maximum value of the engine rotational speed Ne of 6000 [rpm] (=100÷1×60).

As shown in FIG. 4, when the engine E is operating in the three-cylinders-deactivation mode, three explosions occur at equal angular intervals of 240° each time the crankshaft of the engine E makes two revolutions. Stated otherwise, the engine E undergoes the explosion 1.5 times during one revolution of the crankshaft. Therefore, the muffled engine sound NZe generated at this time chiefly includes a 1.5th-order component of the engine rotation frequency fe. A quotient obtained by dividing the minimum value of the frequencies to be controlled by the ANC apparatus by 1.5 (i.e., 35÷1.5) represents the minimum value of the engine rotational speed fe for operating the ANC circuit 32. Then, the quotient is multiplied by 60 thereby to obtain the minimum value of the engine rotational speed Ne of 1400 [rpm] (=35÷1.5×60). Similarly, a quotient obtained by dividing the maximum value of the frequencies to be controlled by the ANC apparatus by 1.5 (i.e., 100÷1.5) represents the maximum value of the engine rotational speed fe for operating the ANC circuit 32. Then, the quotient is multiplied by 60 thereby to obtain the maximum value of the engine rotational speed Ne of 4000 [rpm] (=100÷1.5×60).

In each of the operational range defining tables, when attention is focused only on the engine rotational speed Ne, the minimum value of the engine rotational speed Ne for operating the ASC circuit 36 is determined depending on the maximum value of the frequencies to be controlled by an ASC apparatus. In other words, a value calculated by adding 200 [rpm] to the maximum value of the frequencies to be controlled by the ANC apparatus represents the minimum value of the engine rotational speed Ne for operating the ASC circuit 36. The ASC apparatus is made up of the detector 30, the detector 34, the ASC circuit 36, the amplifier 20, and the speaker 16.

In each of the operational range defining tables, when attention is focused only on the engine rotational speed change ΔNe, the minimum value of the engine rotational speed change ΔNe for operating the ASC circuit 36 is set to a lower value as the active cylinder number Ncy of the engine E is greater. Specifically, the minimum value of the engine rotational speed change ΔNe in the all-cylinder mode in which the active cylinder number Ncy is six, is lower than that in the two-cylinders-deactivation mode in which the active cylinder number Ncy is four. Also, the minimum value of the engine rotational speed change ΔNe in the two-cylinders-deactivation mode in which the active cylinder number Ncy is four, is lower than that in the three-cylinders-deactivation mode in which the active cylinder number Ncy is three. The reasons for such settings are as follows: Generally, as a torque which the engine E is required to produce is higher, the active cylinder number Ncy is greater, and when the torque is high, the driver of the vehicle often wants to drive the vehicle in a sporty way. Therefore, as the active cylinder number Ncy is greater, the minimum value of the engine rotational speed change ΔNe for operating the ASC apparatus is set to a lower value thereby to make the ASC apparatus operable more easily. Thus, the ASC apparatus is operated in a manner to meet the demands of the driver.

(4) Speaker 16:

The speaker 16 outputs the control sound CS based on the combined control signal Scc from the acoustic control system 12. Therefore, when the acoustic control system 12 operates as the ANC apparatus, the speaker 16 outputs a canceling sound for canceling the muffled engine sound NZe, and when the acoustic control system 12 operates as the ASC apparatus, the speaker 16 outputs a sound effect as a quasi-engine sound.

(5) Microphone 18:

The microphone 18 detects the difference, i.e., an error, between the muffled engine sound NZe and the control sound CS serving as the canceling sound, as a residual noise, and outputs an error signal e representative of the residual noise to the ANC circuit 32 of the acoustic control system 12.

2. Selection of an Operational Range Defining Table

Figure 7:
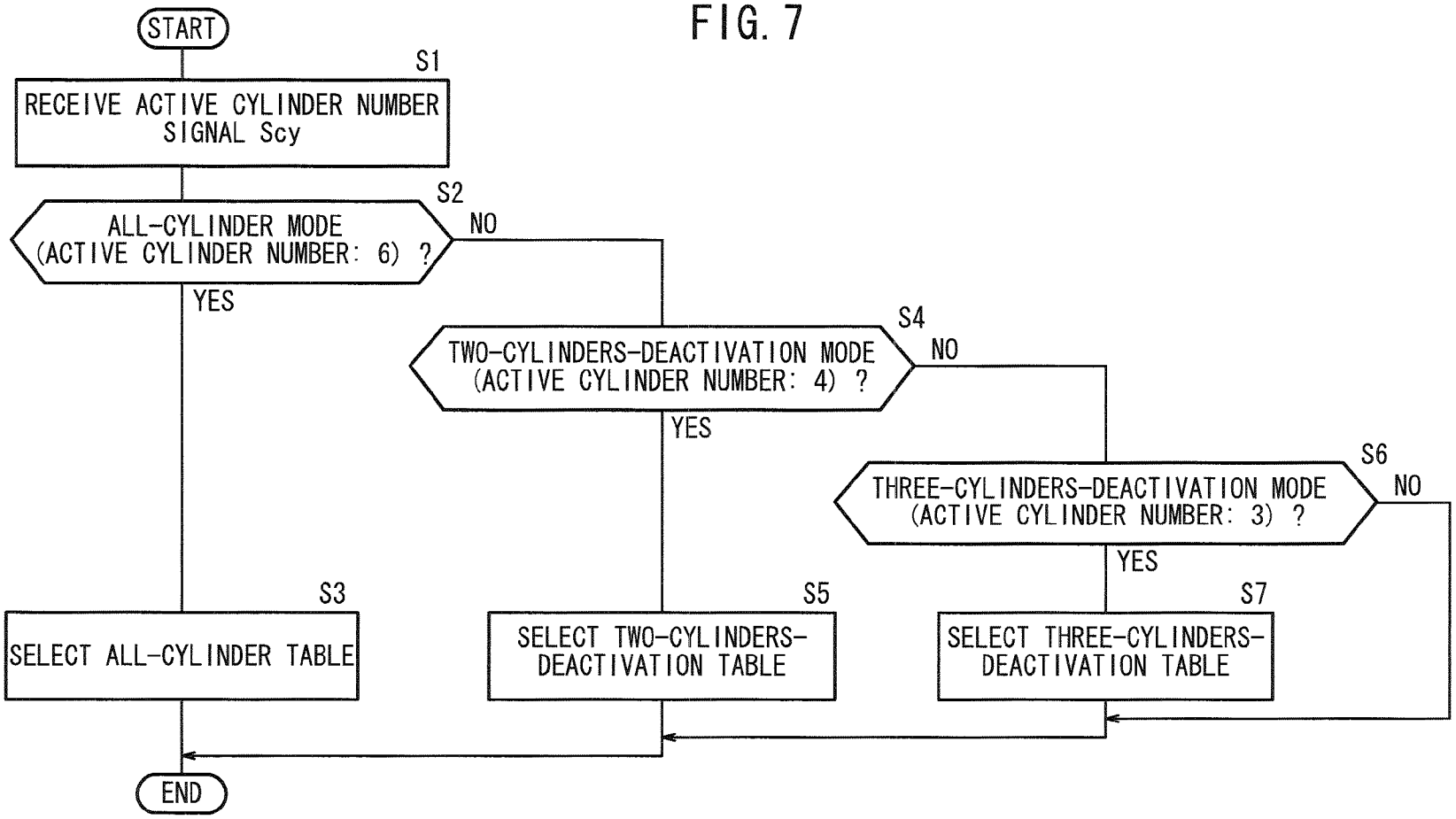
FIG. 7 is a flowchart of an operation sequence in which an operation switcher of the acoustic controller selects an operational range defining table.

FIG. 7 is a flowchart of an operation sequence in which the operation switcher 38 selects an operational range defining table.

In step S1 shown in FIG. 7, the operation switcher 38 receives the active cylinder number signal Scy from the FI ECU 22. In step S2, the operation switcher 38 determines whether the active cylinder number Ncy represented by the active cylinder number signal Scy is six (all-cylinder mode) or not. If the active cylinder number signal Scy indicates the all-cylinder mode (S2: Yes), then the operation switcher 38 selects the all-cylinder table (FIG. 6A) in step S3.

If the active cylinder number signal Scy does not indicate the all-cylinder mode (S2: No), then the operation switcher 38 determines whether the active cylinder number Ncy represented by the active cylinder number signal Scy is four (two-cylinders-deactivation mode) or not in step S4. If the active cylinder number signal Scy indicates the two-cylinders-deactivation mode (S4: Yes), then the operation switcher 38 selects the two-cylinders-deactivation table (FIG. 6B) in step S5.

If the active cylinder number signal Scy does not indicate the two-cylinders-deactivation mode (S4: No), then the operation switcher 38 determines whether the active cylinder number Ncy represented by the active cylinder number signal Scy is three (three-cylinders-deactivation mode) or not in step S6. If the active cylinder number signal Scy indicates the three-cylinders-deactivation mode (S6: Yes), then the operation switcher 38 selects the three-cylinders-deactivation table (FIG. 6C) in step S7. If the active cylinder number signal Scy does not indicate the three-cylinders-deactivation mode (S6: No), then it is considered that the acoustic control system 12 is in operation, but the engine E is not operating (e.g., the engine key is in an "accessory" position). In this case, the operation switcher 38 does not select any of the operational range defining tables, and does not operate either of the ANC circuit 32 and the ASC circuit 36.

3. Advantages of the Present Embodiment

According to the present embodiment, as described above, an operational range defining table is selected depending on the active cylinder number Ncy of the engine E, thereby changing the operational ranges of the ANC circuit 32 and the ASC circuit 36. It is thus possible to perform an acoustic control process depending on the active cylinder number Ncy. As a result, the ANC circuit 32 and the ASC circuit 36 can be used in a more appropriate situation.

According to the present embodiment, the minimum value of the engine rotational speed Ne for operating the ANC circuit 32 is set to a quotient obtained by dividing the minimum value of the frequencies to be controlled by the ANC apparatus by the order (3 for the all-cylinder mode, 1 for the two-cylinders-deactivation mode, and 1.5 for the three-cylinders-deactivation mode) of a chiefly generated frequency component of the muffled engine sound NZe with respect to the engine rotation frequency fe, and the maximum value of the engine rotational speed Ne for operating the ANC circuit 32 is set to a quotient obtained by dividing the maximum value of the frequencies to be controlled by the ANC apparatus by the above order. In this manner, an operational range for the ANC circuit 32 can be set appropriately.

According to the present embodiment, as the active cylinder number Ncy is greater, the minimum value of the engine rotational speed change ΔNe for operating the ASC circuit 36 is set to a lower value. Generally, as a torque which the engine E is required to produce is higher, the active cylinder number Ncy is greater, and when the torque is high, the driver of the vehicle often wants to drive the vehicle in a sporty way. According to the present embodiment, as the active cylinder number Ncy is greater, the minimum value of the engine rotational speed change ΔNe for operating the ASC circuit 36 is set to a lower value thereby to make the ASC circuit 36 operable more easily. Thus, the ASC circuit 36 is operated in a manner to meet the demands of the driver.

B. Applications of the Present Invention

The present invention is not limited to the above embodiment, and it should be understood that various changes and modifications may be made therein without departing from the scope of the appended claims. For example, the following structures may be adopted.

In the above embodiment, the operation switcher 38 switches between operations of the ANC circuit 32 and the ASC circuit 36 based on the engine rotational speed Ne and the engine rotational speed change ΔNe. However, the operation switcher 38 may switch between operations of the ANC circuit 32 and the ASC circuit 36 based on either one of the engine rotational speed Ne and the engine rotational speed change ΔNe. Alternatively, the operation switcher 38 may switch between operations of the ANC circuit 32 and the ASC circuit 36 based on a vehicle speed and a change in a vehicle speed.

In the above embodiment, the engine E has six cylinders. However, the engine E is not limited to six cylinders, but may have four cylinders, eight cylinders, ten cylinders, twelve cylinders, or the like.

In the above embodiment, the engine rotational speed Ne for operating the ANC circuit 32 is set based on the minimum and maximum values of the frequencies to be controlled by the ANC apparatus. However, such a setting scheme is not limitative. In the above embodiment, as the active cylinder number Ncy is greater, the minimum value of the engine rotational speed change ΔNe for operating the ASC circuit 36 is lower. However, the minimum value of the engine rotational speed change ΔNe for operating the ASC circuit 36 may be set according to another procedure, e.g., may be set to one value irrespectively of the active cylinder number Ncy.

The invention claimed is:

1. An active acoustic control system comprising:

an active noise control apparatus (ANC apparatus) for outputting a canceling sound to cancel a passenger compartment noise;

an active sound control apparatus (ASC apparatus) for outputting a quasi-engine sound; and an operation switcher for switching between operation of the ANC apparatus and operation of the ASC apparatus, based on an operational range of the ANC apparatus and an operational range of the ASC apparatus which are related to at least an engine rotation frequency, wherein the operation switcher changes the operational range of the ANC apparatus and the operational range of the ASC apparatus depending on an active cylinder number of an engine the engine rotation frequency has a minimum value for operating the ANC apparatus, the minimum value being set to a quotient obtained by dividing a minimum value of frequencies to be controlled by the ANC apparatus, by the order, with respect to the engine rotation frequency, of a chiefly generated frequency component of the passenger compartment noise depending on the active cylinder number; and the engine rotation frequency has a maximum value for operating the ANC apparatus, the maximum value being set to a quotient obtained by dividing a maximum value of the frequencies to be controlled by the ANC apparatus, by the order.

* * * * *